United States Patent [19]

Borg et al.

[11] 4,120,344

[45] Oct. 17, 1978

[54] METHOD OF CONTINUOUS CASTING TELLURIUM CONTAINING STEELS

[75] Inventors: Arthur C. Borg, Calumet City; Alex Zletz, Naperville, both of Ill.

[73] Assignee: Standard Oil Company (Indiana), Chicago, Ill.

[21] Appl. No.: 817,143

[22] Filed: Jul. 20, 1977

[51] Int. Cl.[2] ..... B22D 11/00

[52] U.S. Cl. ..... 164/73

[58] Field of Search ..... 164/72, 73, 121; 75/123 AA

[56] References Cited

U.S. PATENT DOCUMENTS

| | | | |
|---|---|---|---|
| 3,574,606 | 4/1971 | Edgar et al. | 75/123 AA |
| 3,640,860 | 2/1972 | Miller | 164/73 |
| 3,841,995 | 10/1974 | Bertolacini et al. | 208/89 |

*Primary Examiner*—Francis S. Husar
*Assistant Examiner*—John McQuade
*Attorney, Agent, or Firm*—Mark J. DiPietro; Arthur G. Gilkes; William T. McClain

[57] ABSTRACT

Tellurium steel may be cast with a white mineral oil lubricant preventing dangerous explosive reactions.

4 Claims, No Drawings

METHOD OF CONTINUOUS CASTING TELLURIUM CONTAINING STEELS

BACKGROUND OF THE INVENTION

1. Field of the Invention

This invention relates to the lubrication of the continuous casting of steels. More particularly, this invention relates to the use of white mineral oil as a lubricant in continuous casting of tellurium steels.

2. Discussion of the Prior Art

Continuous casting is an innovation of steel making technology. This continuous process eliminates the need to cast many single ingots of steel. In continuous casting, a heat of molten steel is poured into a continuous casting machine producing one long single cast of steel. The steel when solidified is cut into individual slabs or billets.

One problem which appears in continuous casting is that an unlubricated casting will fail. The metal, as it cools in the mold, will weld to and destroy the mold. Lubricants are commonly introduced in the interface between the water cooled mold and the steel being cast. As the lubricant contacts the molten steel the lubricant is consumed by the heat. The cooling, lubrication, resulting gases and the related pressure are believed to prevent the steel from welding to the mold.

In non-tellurium containing steel technology many lubricants are commonly used. Examples of such lubricants are inorganic salts, Crambe and Rape Seed oil, saturated and unsaturated fatty acid, lubricant oils, polybutenes, glass and oil compositions, polyesters, and polymethylsiloxane fluids. Examples of United States patents which contain examples of these lubricants are U.S. Pat. Nos. 3,040,396; 3,220,070; 3,397,734; 3,574,112; 3,620,290; 3,685,986; and 3,937,269.

These common organic lubricants are of no use in the continuous casting of steels which contain tellurium. Upon contact with steels containing tellurium, conventional lubricants explode in the casting process. These violent explosions commonly are dangerous to casting personnel and are destructive to the casting and the continuous casting machinery.

Thus, it is an object of the invention to produce a lubricant for tellurium containing steels in continuous casting processes. It is also an object of the invention to provide an inexpensive lubricant for the continuous casting of tellurium steels which avoids the danger of explosion and damage to the personnel, product, and plant equipment.

BRIEF SUMMARY OF THE INVENTION

White oils have been discovered to be effective lubricants for the continuous casting of steels containing tellurium. Tellurium steels contain from about 0.01 to about 10,000 parts per million of tellurium, preferably about 1 to about 700 parts per million based on the steel. White oils, which are non-explosive casting lubricants for tellurium steel, are described as clear white petroleum mineral oils. White oils are commonly nearly transparent viscous fluids having preferably the following general properties.

TABLE 1

| Property | Min. | Max. |
|---|---|---|
| Specific gravity | 0.082–0.890 | |
| Viscosity at 37.8° C., cSt | 10– 100 | |

TABLE 1-continued

| | | |
|---|---|---|
| at 37.8° C., SSU | 150–400 | |
| Sulfur | Nil | |
| Flashpoint, ° C., COC | 150–300 | |
| Pourpoint, ° C. | −20–−5 | |
| Saybolt color | 10–30 | |
| UV Absorbance on dimethyl sulfoxide (DSMO) extract | | |
| 280–289 nm | | 4.00 max. |
| 290–299 nm | | 3.30 max. |
| 300–329 nm | | 2.30 max. |
| 330–350 nm | | 0.80 max. |

Purity specification standards are established for technical grade white oils by the U.S. Food and Drug Administration under regulation 21 CFR 121.2589(b).

DETAILED DESCRIPTION OF THE INVENTION

Molten tellurium steel, due to some unknown property, in contact with common organic continuous casting lubricants causes explosive reactions. A very small amount of tellurium will cause this dangerous effect. A large amount of tellurium steel is produced in the U.S. Tellurium-steel alloy is easily machined.

White oil is a highly refined clear petroleum mineral oil. The appearance of white oil is commonly clear, viscous, generally colorless and odorless. White oil is commonly produced in great quantities by the petroleum industry. Two major processes are commonly used to produce white mineral oils. These processes are hydrogenation and sulfonation. Both processes commonly are believed to eliminate hydrocarbon oil fractions of relatively high reactivity from the oil. In the sulfonation process, the oil fractions react with the $SO_3$ and are removed by water wash leaving less reactive fractions in the oil. In the hydrogenation process, the reactive fractions are reduced by hydrogen to hydrocarbons essentially unreactive to tellurium steel.

The hydrogenation processes repeatedly treats the lubricating oil of any viscosity with hydrogen over a hydrogenation catalyst until the oil is essentially fully hydrogenated. The highly hydrogenated lubricant contains essentially fully hydrogenated aryl and unsaturated hydrocarbons. The hydrogenated white oil contains few comparatively reactive components.

Descriptions of hydrogenation processes are found in U.S. Pat. No. 3,841,995 and in an article "Hydroprocessing for White Oils," *Chemical Engineering,* vol. 82, No. 19, Sept. 15, 1975, pp. 87–89. Description of Sulfonation processes is found in G. D. Hobson and W. Pohl, Modern Petroleum Technology, (4th ed. 1973) J. Wiley and Sons, pp. 818–822.

In continuous casting, molten metal is poured from a vessel into a continuous casting machine. The metal goes into a vessel called a tundish which holds the metal. The rate the metal moves through the mold is regulated by the speed needed to solidify a solid metal skin around the molten interior. The mold is commonly a water cooled copper jacketed device which shapes the molten metal into a large billet or slab. The form of the cast is held by strength of the solidified metal skin formed by the mold. The cast is not fully solid until well after being cast. Lubricants are commonly injected into the interface between the mold and the molten metal as it cools. Needless to say, in this extremely hot environment, any organic lubricant would be consumed. In the case of tellurium steels only white oils are consumed without violent reaction and in such a manner to pose no danger of explosion damage to personnel, equipment and product.

EXAMPLE 1

A 100 pound steel melt containing tellurium at a concentration of about 300 parts per million is heated to a temperature of 3,000° F. A bar of steel is dipped into a conventional test lubricant. In this example, it is rape seed oil. The bar covered with conventional lubricant is plunged into the melt at 3,000° F. Very violent explosions, fires and smoke occur.

EXAMPLE 2

In the same procedure as in Example 1 the same heated metal has thrust into it a steel bar coated with white oil. Although the white oil is actively consumed and some smoking occurs the dangerous explosions and violent reactions are absent.

EXAMPLE 3

An attempt was made to cast a heat of steel containing 700 parts per million tellurium in conventional casting equipment. In this example, conventional rape seed oil lubricant oil was used. Violent, dangerous explosions occur, and smoke was produced (aborting the attempt).

EXAMPLE 4

A 200 hundred ton heat of steel containing 700 parts per million tellurium is cast using conventional casting equipment but using white mineral oil exclusively as a lubricant. The casting process was occasioned by some fire and popping but the explosions were not dangerous. The personnel and the casting were in no danger of damage.

We claim:

1. In a process of continuous casting of tellurium steel, which includes pouring tellurium steel into a mold to form a cast and lubricating the interface between the mold and said tellurium steel, the improvement comprises lubricating said interface with a composition consisting essentially of a white petroleum mineral oil.

2. The process of claim 1 wherein the tellurium steel comprises a major portion of steel and from about 0.1 to about 10,000 parts per million by weight of tellurium.

3. In process of claim 2 wherein the tellurium steel comprises a major portion of steel and from about 1 to about 1,000 parts per million by weight of tellurium.

4. The process of claim 2 wherein the white oil has a viscosity from about 50 to about 400 Saybolt Universal Seconds at 37.8° C.

* * * * *

UNITED STATES PATENT OFFICE
CERTIFICATE OF CORRECTION

Patent No. 4,120,344 Dated October 17, 1978

Inventor(s) Arthur C. Borg and Alex Zletz

It is certified that error appears in the above-identified patent and that said Letters Patent are hereby corrected as shown below:

| Column | Line | |
|---|---|---|
| 1 | 66 | *"0.082" should be -- 0.820 --. |
| 2 | 2 | *"150-400" should be -- 50-400 --. |

Signed and Sealed this

*Eighth* Day of *May 1979*

[SEAL]

*Attest:*

RUTH C. MASON
*Attesting Officer*

DONALD W. BANNER
*Commissioner of Patents and Trademarks*